United States Patent [19]

Ban

[11] 3,946,269

[45] Mar. 23, 1976

[54] ELECTRONIC FLASH SYSTEM

[76] Inventor: Itsuki Ban, 829, Higashi, Oizumimachi, Nerima, Tokyo, Japan

[22] Filed: Jan. 14, 1974

[21] Appl. No.: 433,382

Related U.S. Application Data

[63] Continuation of Ser. No. 256,122, May 23, 1972, abandoned.

[30] Foreign Application Priority Data

May 25, 1971 Japan ..... 46-35156

[52] U.S. Cl. ..... 315/151; 315/159; 315/241 P

[51] Int. Cl.[2] ..... H05B 37/02

[58] Field of Search ..... 315/149, 151, 159, 241 R, 315/241 P

[56] References Cited

UNITED STATES PATENTS

| | | | |
|---|---|---|---|
| 3,591,829 | 7/1971 | Murata et al. | 315/241 P X |
| 3,675,074 | 7/1972 | Dennewitz | 315/241 P |
| 3,710,701 | 1/1973 | Takishima et al. | 315/227 X |
| 3,818,266 | 6/1974 | Vital et al. | 315/151 |

*Primary Examiner*—R. V. Rolinec
*Assistant Examiner*—Lawrence J. Dahl
*Attorney, Agent, or Firm*—Haseltine, Lake & Waters

[57] ABSTRACT

An electronic flash system including a flashtube, a trigger circuit for actuating the emission of the flashtube, an electric energy storage means for storing the electric energy emitting the flashtube, a discharge circuit connecting the electric energy storage means to the flashtube to produce a flash of light, said discharge circuit including a switching means for electrically break-and-make controlling a connection of the electric energy storage means and the flashtube, a monitoring means for monitoring luminosity of the reflected light from the object to be photographed relying on the flash of light, said monitoring means being adapted to generate an output signal when the luminosity reaches a predetermined value, and a control means for controlling actuation of the switching means in the discharged circuit, said control means being started by its operation in response to actuation of the trigger circuit, the control means generating a control signal for controlling operation of the switching means to open the discharge circuit whenever the output signal from the monitoring means is applied thereto, the switching means being adapted to controll its actuation so that the discharge circuit is maintained in off condition upon termination of performance after the passage of a prescribed time.

9 Claims, 5 Drawing Figures

ELECTRONIC FLASH SYSTEM

This application is a continuation of application Ser. No. 256,122, filed May 23, 1972, now abandoned.

BACKGROUND OF THE INVENTION

This invention relates to an electronic flash system for obtaining an artificial light source in photographing, and more particularly to an improved electronic flash system capable of automatic control of a luminosity of light energy produced by a flashtube provided therein.

According to a conventinnally known counterpart of the electronic flash system of the invention, a monitoring means is provided which integrates a quantity of reflected light energy from the object being illuminated by a light energy produced by a flashtube and which generates a signal when the quantity of reflected light energy has been integrated, whereupon the electrical energy being discharged from a storage means coupled to the flashtube is made to bypass the flashtube for the correct exposure of photographic film or the like. With such a prior art electronic flash system, an exposure time of film is varied in accordance with distance to the object. It is apparent from luminuous characteristics that the light energy produced by the flashtube rapidly increases in luminous intensity which is powerful. For this reason, although an exposure time of film is automatically controlled in accordance with distance to the object thereby controlling film exposure value at proper rate, a color balance would be disturbed and a contrast would be abnormal due to "reciprocity law failure" since film is exposed by a powerful light even for short period, particularly, in case of short distance to the object. A conventional electronic flash system is fabricated by neglecting the fact that photographic density is against "Bensen-Roscoe's law or reciprocity law".

SUMMARY OF THE INVENTION

It is a primary object of the invention to provide an electronic flash system which keeps intensity of reflected light incident upon the film from the object irrespective of distance to the object, and which maintains an exposure time constant and prevents photographic density from being improper due to "reciprocity law failure" thereby taking photographs at proper exposure.

A further object of the invention is to provide an electronic flash system which supplies intermittently electric energy for emitting the flash to the flashtube to control luminous intensity of light energy produced by the flashtube and which makes intensity of reflected light incident upon the film from the object.

Another object of the invention is to provide an electronic flash system wherein a monitoring means includes a photoelectric element on which the reflected light from the object is incident and monitors luminous intensity of the reflected light from the object, the monitoring means being adapted to produce the output signal therefrom when luminous intensity reaches a predetermined value thereby controlling the electric energy to the flashtube, and wherein luminous intensity of flash of light produced by the flashtube, although containing a little ripples, may be kept substantially constant in accordance with distance to the object.

Still further object of the invention is to provide an electronic flash system which comprises a control means for controlling operation of a switching means controlling the supply of electric energy to the flashtube, the control means being adapted to initiate its actuation in response to a trigger circuit for actuating the emission of the flash-tube, the switching means being intended to control its actuation so as to cut off supply of electric energy to the flashtube whenever the output signal from the monitoring means is applied to maintain luminous intensity of the flash of light produced by the flashtube substantially constant, the switching means being adapted to further control its actuation to completely cut off supply of electric energy to the flashtube upon termination of its actuation after the passage of a predetermined time thereby producing flash of light at a prescribed luminous intensity from the flashtube for a predetermined period.

Yet another object of the invention is to provide an electronic flash system which is capable of properly controlling luminous intensity of flash of light produced by the flashtube in accordance with the camera lens aperture value and sensitivity of the film to be used.

Another object and advantages will become apparent from the following description of the exemplary embodiment of the invention illustrated in the drawings, in which:

DESCRIPTION OF THE PREFERRED EMBODIMENTS

Figure 1:
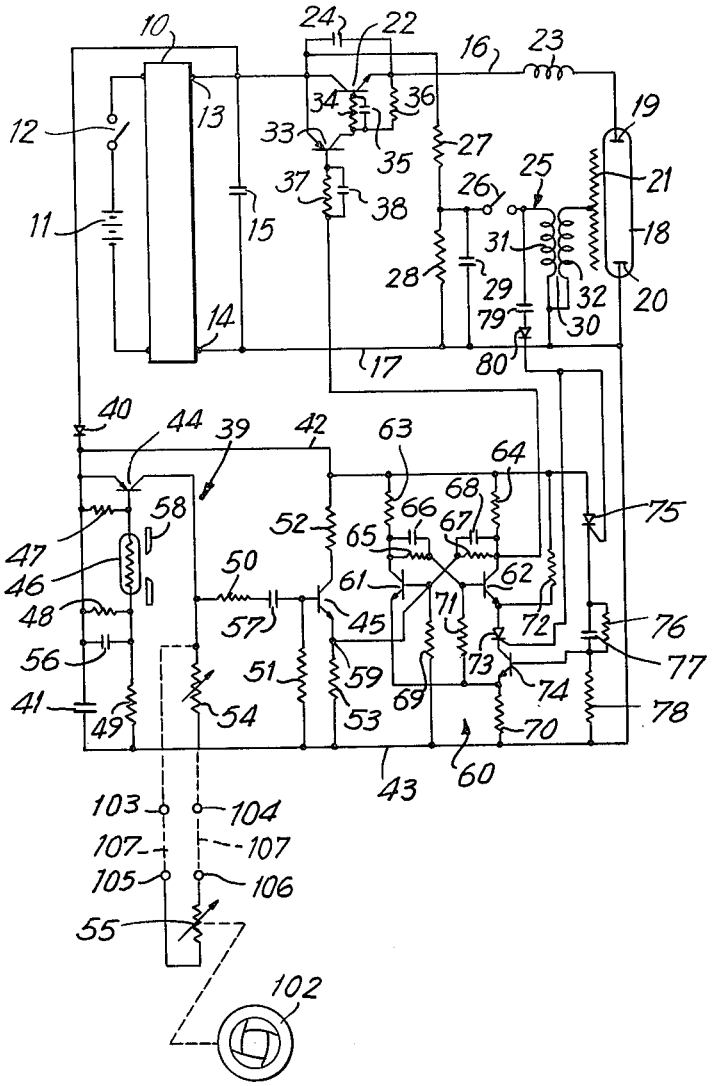
FIG. 1 is a schematic wiring diagram showing an embodiment of an electronic flash system in accordance with the present invention.

Referring to FIG. 1, there is shown one embodiment of an electronic flash system according to the present invention. Numeral 10 designates a transistor booster oscillator circuit or DC converter which is connected by a normally opened power switch 12 to a power supply 11 and which is adapted to develop a direct-current high voltage when the power switch 12 is closed. Between a plus output terminal 13 and a minus output terminal 14 of the transistor booster oscillator 10, a main condenser or capacitor 15 is coupled which stores therein the electrical energy to be translated into light energy in the form of flash light by the output of the oscillator circuit. The capacitor 15 is connected by an upper conductor 16 and a lower conductor 17 to respective principal main electrodes 14 and 20 of flashtube 18. The upper conductor 16 comprises a transistor 22, an inductor 23, and a condenser 24 coupled between the emitter and collector of the transistor 22 as will be fully described later. The flashtube 18 is of the type having the main electrodes 19 and 20 disposed in a gaseous medium such as xenon within a light transparent envelope, and is triggered by a conventional trigger circuit 25 including a synchronized switch 26 automatically operated, as by relay operation in conjunction with the shutter of camera. The trigger circuit 25 includes resistors 27 and 28 as well as the synchronized switch 26, triggering capacitor 29, and a triggering transformer 30. The triggering transformer 30 has one end of its primary coil 31 and one end of it secnndary coil 32 connected together and connected to the conductor 17. The other end of the primary coil 31 is connected through the synchronized switch 26 to the triggering capacitor 29 and the other end of the secondary coil 32 is connected to a triggering electrode 21 of the flashtube 18. The transistor 22 is incorporated in a circuit by which the electrical energy stored in the main capacitor 15 is supplied to the flashtube 18 to illuminate the latter, and is of the type of NPN including the collector connected to the plus output terminal 13 of the booster circuit 10, the emitter connected by the inductor 23 to the main electrode 19 of the flashtube 18, and the base coupled to the collector of another PNP transistor 33 by a resistor 34 and speedup capacitor 35 connected in parallel with each other. The emitter of the transistor 33 is connected to the collector of the transistor 22 whereas the collector of the transistor 33 is connected by a resistor 36 to the emitter of the transistor 22. The transistor 33 is brought from cut-off into heavy conduction in response to application of the output of a control means 70 as will be described later, to the base of the transistor 33 by a resistor 37 and speedup capacitor 38 connected in parallel with each other. The flashtube 18 is discharged and thus illustrated by the electrical energy stored in the main capacitor 15 when it is triggered in association with closing of the normal opened synchronized switch 26 in the trigger circuit simultaneously with bringing the transistor 22 into heavy conduction.

The electronic flash system of the invention includes a monitoring means designated at 39 for monitoring quantity of reflected light from the object to be photographed. The monitoring means 39 comprises a diode 40 and capacitor 41 connected in series with each other between the plus output terminal 13 and the minus output terminal 14 of the booster circuit 10 to obtain a stable potential difference between conductors 42 and 43 connected the respective electrodes of the capacitor 41. This monitoring means 39 is comprises of transistors 44 and 45, a photoelectric element 46 for receiving the light reflected from the object to be photographed, resistances 47, 48, 49, 50, 51, 52, and 53, variable resistors 54 and 55, and capacitors 41, 56, and 57. The photoelectric element 46 may be served by a photoconductor such for example as cadmium sulfide or by a silicon or selenium photoelectric cell. The capacitors 41 and 56, whose capacitance may be about 40 microfarads each, are to be charged via the diode 41 for voltage stabilization. The reflected light from the object to be photographed is applied through a diaphragm 58 as will be described to the photoelectric element 46. The photoelectric element 46 decreases in electrical resistance upon being illuminated, so that the transistor 44 has its base current increased and its collector current correspondingly affected. A varied portion of photocurrent of the photoelectric element 46 amplified by the transistor 44 is further amplified by the transistor 45 via the resistance 50 and capacitor 57. At this moment, and emitter current value of the transistor 45 is proportional to the illumination incident upon the photoelectric element 46 whereas a voltage drop volume due to the resistance 53 is in turn proportional to a light receiving illumination of the photoelectric element 46.

The control means 60 forms a circuit arrangement similart to the well known flip-flop circuit and includes first and second transistors 61 and 62 which are adapted to alternatively repeat on and off conditions. The collector of the first transistor 61 is connected by a resistance 63 to the conductor 42 whereas the collector of the second transistor 62 is connected by a resistance 64 to the conductor 42. The collector of the first transistor 61 and the base of the second transistor 62 are coupled by a resistance 65 and speedup condenser 66 connected in parallel with each other while the base of the first transistor 61 and the collector of the second transistor 62 are coupled by a resistance 67 and speedup condenser 68 connected in parallel with each other. The output of the monitoring means 39 is applied from a connection 59 to the base of the first transistor 61 which is connected by a resistance to the conductor 43. The emitter of the first transistor 61 is connected by a resistance 70 to the minus or zero conductor 43. Further, the base of the second transistor 62 is coupled by a resistor 71 to an electric potential point of the emitter of the first transistor 61. The emitter of the second transistor 62 is connected by a resistance 72 to the plus conductor 42 on the one hand and is connected by a silicon controlled rectifier 73 (hereinafter referred to as an SCR), a transistor 74 and the resistance 70 to the minus conductor 43. Between the plus conductor 42 and the minus conductor 43, an SCR 75, a resistance 76 and condenser 77 connected in parallel with each other, a resistance 78 are in series connected; and the base of the transistor 74 is connected to a connection between the parallel connected resistance 76 and condenser 77 and the resistance 78. A portion of the electrified change of the triggering capacitor 29 is applied as a gate signal by a condenser 70 and diode 80 to the gate electrode each of the SCR 73 and 75 when the synchronized switch 26 for the trigger circuit is closed. The output of the control means 60 is obtained from the collector of the second transistor 62 and applied by the parallel connected resistance 37 and speedup capacitor 38 to the base of the transistor 33.

When the SCR 73 and 75 are in "cutoff" condition under which its anode current is not drained, the second transistor 62 and the transistor 74 are also cut-off. At this time, the base of the first transistor 61 has acquired an electric potential to which the base current is applied while the first transistor 61 is brought into on condition. The SCR 73 and 75 may be brought in on condition in response to closing the synchronized switch 26 to allow the gate signal to be applied to the gate electrode each of the SCR 73 and 75. This allows the base of the transistor 74 to have an electric potential to which the base current is applied while the transistor 74 is brought into heavy conduction. The transistor 74 is brought into on condition while the second transistor 62 is brought from cutoff into heavy conduction. A resistance value each for the resistor 65, 67, 69 and 70 is suitably determined so that the second transistor 62 is brought into on condition and the first transistor 61 is in cutoff condition whenever the SCR is in on condition. The output of the control means 60 is applied to the base of the transistor 33 to bring the transistor 33 into on condition when the second transistor 62 is brought into on condition. The transistor 22 is in on condition with respect to the transistor 33 in on condition. That is, the synchronized switch 26 for the trigger circuit 25 is closed for photographing to trigger the flashtube 18. Then, an electric energy stored in the main capacitor 15 is supplied to the flashtube 18 to illuminate the latter. A flash of light produced by the flashtube 18 increases in luminosity as shown by a curve 81 in FIG. 4 with the passage of time. Accordingly, the reflected light which is received from the object by the photoelectric element 46 increases in luminous intensity. When luminosity of the reflected light received by the photoelectric element 46 is over a predetermined value, a voltage drop due to the resistance 53 of the monitoring means 39 increases while the voltage applied to the base of the first transistor 61 has become high to bring the latter from outoff into on condition. In response thereto, the second transistor 62 is brought into cutoff condition by lowering the voltage applied to its base. Simultaneously therewith, the transistor 22 is in cutoff condition to open a discharge circuit for the flashtube 18. As a result, the flashtube 18 decreases in arc-plasma to reduce it luminous intensity and thus reduce a light receiving illumination of the photoelectric element 46. In association with reduction of light receiving illumination of the photoelectric element 46, the voltage applied to the base of the first transistor 61 is decreased lower than a value at which the base current of the transistor 61 runs thereby bringing the first transistor in cutoff condition. When the first transistor 61 is brought into cutoff condition, the second transistor is turned over to on condition with the transistors 33 and 22 in on condition. Whereupon, the discharge circuit for the flashtube 18 and flash of light produced by the flashtube 18 increases in luminous intensity. The reflected light received from the object by the photoelectric element 46 again reaches a predetermined illumination, and as previously mentioned, the first transistor 61 is brought into on condition whereas the second transistor 62 is in cutoff condition. Consequently, the discharge circuit for the flashtube 18 is opened.

As fully mentioned above, in association with closing of the synchronized switch 26 of the trigger circuit 25, the flashtube 18 is started to emit light and its luminous intensity is increased or decreased in accordance with hysteresis characteristics of an inverted switching circuit which comprises the first and second transistors 61 and 62 of the control means 60. This flashtube is maintained at substantially constant luminous intensity notwithstanding ripples as shown by curves 82, 83 or 84 in FIG. 4. A switching speed for the transistor 22 for controlling the operation of the discharge circuit for the flashtube 18 is of the order of 0.5–2 microseconds so that the transistor 22 is almost used in a saturated area but used for short period in an active area. For this reason, the transistor 22 with rated current of 2—2 amperes may be used even where the discharge current of the flashtube 18 is over 200 amperes. The inductor 23 and capacitor 24 are incorporated in the discharge circuit to prevent the transistor 22 from break down due to heat generated by short cycle of the switching of the transistor 22. More specifically, the indicator 23 serves to moderate intensity of the discharge current of the flashtube 18 whereas the capacitor 24 functions to absorb an induced electromotive force by the inductor 23 when the transistor 22 is in cutoff condition and thereby facilitating a cutoff action of the transistor 22.

The condenser 77 is gradually charged with the passage of time when the SCR 75 is brought into on condition. On the other hand, the base voltage of the transistor 74 is reduced, after the passage of a certain time, and brought from on condition into cutoff condition. Correspondingly, an inverted switching action of the first and second transistors 61 and 62 is obstructed to stop illumination of the flashtube 18. More specifically, the flashtube 18 condinues its illumination for the period which is determined by time constant according to the condenser 77 and the resistance 78, and then stops the same. All performances having been completed, the current applied to the SCR 75 is less then the holding current. When the transistor 74 is brought into cutoff condition, the holding current is not drained into the SCR 73 thereby bringing the SCR 73 and 75 into off condition.

It will be readily understood that an exposure volume of film disposed on the substantially same position as the photoelectric element 46 may be constant since intensity of light incident upon the photoelecric element 46 is constant irrespective of distance of the object to be photographed. Accordingly, a photograph may be automatically taken at a proper exposure.

Figure 2:
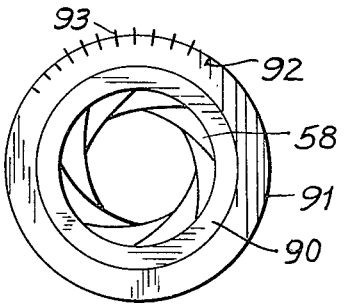
FIG. 2 is a representation explanatory of a mechanism for varying light quantity incident upon the photoelectric element shown in FIG. 1 according to the camera lens aperture and film sensitivity.
Figure 3:
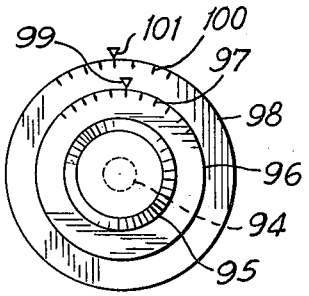
FIG. 3 is a representation explanatory of a mechanism for varying the variable resistance of FIG. 1 in accordance with the camera lens aperture and film sensitivity.

It will be understood from the following description with reference to FIGS. 2 and 3 how to operate the diaphragm 58 disposed in front of the photoelectric element 48 and the variable resistor 54.

In FIG. 2, numeral 90 denotes a manually operated ring which is rotatably mounted with respect to a camera body for controlling a diaphragm 58. The diaphragm 58 is adapted to be varied by rotatably operating the ring thereby rotating a dial 91 mounted thereon. A film sensitivity index scale 93 and F number scale 92 are set by operating the ring 90 in accordance with the brightness of the object and sensitivity of film when photographing. The reflected light from the object according to the aperture dimensions of the diaphragm 58 is incident upon the photoelectric element 46. The flash luminous intensity is thus controlled so that a prescribed illumination is variable in accordance with film sensitivity and lens aperture irrespective of distance of object. As a result, the light incident upon the film has the same illumination or the proportional illumination. The photoelectric element 46 is preferably mounted in the camera by way of T.T.L. system, namely, through the lens in which the element is mounted behind the lens system. Instead of the diaphragm 58, a gray filter by which the transmitted light is varied may be employed to be moved in front of the photoelectric element 46 in accordance with film sensitivity.

In the place of adjustment of the diaphragm 58, the variable resistor 54 in FIG. 1 may be varied in response to film sensitivity and aperture. To this end, a mechanism is provided as shown in FIG. 3. In FIG. 3, mumeral 94 designates a rotary shaft which is coupled to an operating shaft (not shown) for the variable resistor 54 and which includes a knob 95 and dial 96 fixed thereto. An F number scale 97 is graduated on the dial 96. A dial 98 is rotatably mounted with respect to the shaft 94 and includes a mark 99 and film sensitivity index scale 100 arranged thereon. A mark 101 is disposed on a fixed frame (not shown) so as to correspond to the film sensitivity index scale 100 on the dial 98. The dial 98 is operated to allow the scale 100 to be alignment with the mark 101 according to the sensitivity of film to be used. Nextly, the knob 95 is rotated to allow the F number scale 97 on the dial 96 to be aligned with the mark 99 on the dial 98 according to the aperture value set by the camera. In this manner, the variable resistor 54 is varied to effect the same action as when the diaphragm 58 is varied. In FIG. 1, numeral 102 is a camera diaphragm which is adapted to operate the variable resistor 55 in cooperation therewith. Where the variable resistor 55 is employed, terminals 103 and 104 are provided on the side of the electronic flash whereas terminals 105 and 106 are mounted on the side of the camera and connected by detatchable lead wires 107 as shown by the dotted line to the terminals 103 and 104. In this instance, the variable resistor 54 may be omitted. By this arrangement, the variable resistor 55 is varied in response to the operation of camera diaphragm 102 to obtain the same function as the variable resistor 54.

Figure 4:
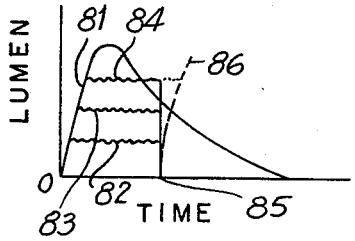
FIG. 4 is a curve showing the light producing characteristic of the electronic flash system in accordace with the invention.

Flash luminosity derived from the electronic flash system according to the invention differs from that of a conventional flash system, which is plotted as a curve 81 in FIG. 4 but is maintained substantially constant as shown curves 82, 83, and 84. The curve 82 is shown as indicative of the distance at which the tube is close to the object, and the curves 83 and 84 are shown as indicative of the respective distances at which the tube is further from the object. Ripple of flash luminosity is determined by the dimension of the inductor 23, volume of the capacitor 24, arc plasma growth, and the period of extinction. A point 85 is plotted to show the period at which illumination of the flashtube is prevented and which is determined by the time constant of the resistor 78. Since the curve 81 upwardly extends from zero, illumination of the flashtube 18 is prevented at the point 85 so that for instance, light quantity and luminosity thereof are not proportional to each other at the curves 82 and 84 thereby resulting in deviation of film exposure. In order to overcome such defect, a circuit is additionally provided so that the SCR 75 and the first transistor 61 are brought in "on" condition at the same time to allow the time when illumination of the flashtube 18 is prevented, to follow a curve 86. In this manner, light quantity received by the photoelectric element 46 is always kept constant irrespective of distance to the object thereby obtaining more accurate film exposure.

Figure 5:
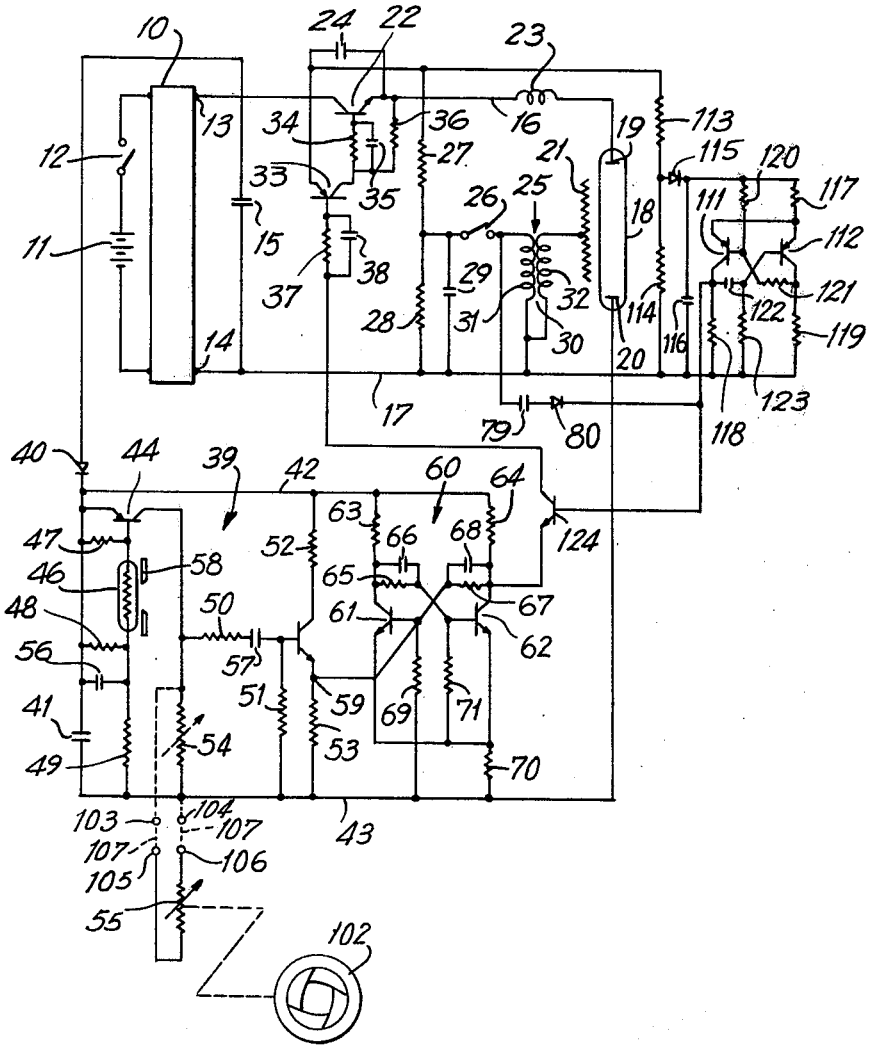
FIG. 5 is a schematic wiring diagram showing another embodiment of the electronic flash system according to the present invention.

An alternative embodiment of the electronic flash system according to the invention is shown in FIG. 5 in which the same numerals are used to illustrate like parts shown in FIG. 1.

The parts designated by the same numerals as shown in FIG. 1 are provided to perform the same function so that the following description will refer to the other parts.

Numeral 110 is a monostable circuit which constitutes a portion of the control means 60 and which includes transistors 111 and 112. The power source for the transistors 111 and 112, which is stabilized by a diode 115 and condenser 116 is used so that voltage between the terminals of the main capacitor 15 is divided by resistances 113 and 114. The emitter of the transistors 111 and 112 is coupled by a common resistor 117 to the anode of the diode 115. The collector of the transistors 111 and 112 are connected by respective resistances 118 and 119 to the minus conductor 17. The base of the transistor 111 is connected by a resistance 120 to the anode of the diode 115 or by a resistance 121 to the collector of the transistor 112. The base of the transistor 112 is coupled by a capacitor 122 to the collector of the transistor 111 and further connected by a resistance 123 to the minus conductor 17. A transistor 124 and the previously mentioned parallel connected resistance 37 and the speedup condenser 38 are provided between the collector of the second transistor 62 and the base of the transistor 33. The collector of the transistor 111 is connected to the base of the transistor 124. A portion of electrified charge of the condenser 29 is applied by the condenser 79 and diode 80 to the base of the transistor 124 in response to closing of the synchronized switch 26.

Upon closing of the synchronized switch 26, the flashtube 18 is triggered by the trigger circuit 25 and a pulse current is drained by the capacitor 79, diode 80, and the capacitor 122 to the resistor 123 to raise the voltage of the base of the transistor thus placing the transistor 112 in cutoff condition. In response thereto, the base potential of the transistor 111 is increased to bring the transistor 111 in on condition. On the other hand, upon closing of the synchronized switch 26, the transistor 124 is brought into on condition simultaneously with placing the second transistor 62 in on condition. Accordingly, the transistor 22 is brought into on condition to close the discharge circuit for the flashtube 18 thereby initiating illumination of the flashtube 18. Flash luminosity of the flashtube 18 is thereafter maintained substantially constant by the switching action of the first and second transistors 61 and 62 as in the embodiment in FIG. 1.

When the transitor 111 is in on condition, the capacitor 122 is charged by the resistance 123 and the transistor 112 is maintained in cutoff condition by the charged current. However, the transistor 112 is intended to place it in on condition since the base voltage of the transistor 112 is reduced and at the same time the transistor 111 is in cutoff condition. In other words, the transistor 111 is placed in on condition for the period corresponding to time constant determined by the capacitor 122 and the resistance 123. Due to the transistor 111 being in cutoff condition, the transistor 124 is brought into cutoff condition since its base potential is reduced. At the same time, the transistor 22 is in cutoff condition to open the discharge circuit for the flashtube 18 to terminate illumination thereof. As above set forth, it is understood that the second embodiment shown in FIG. 5 performs the same function as the first embodiment illustrated in FIG. 1.

Although the invention has been described with reference to specific embodiments, it is apparent that the invention is not to be limited to the embodiments as illustrated, and, accordingly, changes and variations may be made without departing from the spirit and scope of the invention as defined in the appended claims.

What is claimed is:

1. An electronic flash system used for obtaining light energy to illuminate the object to be photographed, comprising:

a flashtube;

an electric energy storage means for storing light energy to be applied to the flashtube;

a discharge circuit connecting the storage means to the flashtube to produce a flash of light;

a trigger circuit connected to said flashtube for actuating the emission of the flashtube;

switching means for controlling the closing and opening of the discharge circuit; monitoring means connected to said switching means for monitoring luminous intensity of reflected light from the object subjected to a flashlight, said monitoring means being adapted to produce an output signal when said luminous intensity of reflected light reaches a predetermined value; control means connected to said switching means for controlling actuation of said switching means, said control means being adapted to produce a control signal for operating said switching means to close the discharge circuit when said trigger circuit triggers the flashtube, said switching means being prevented from being actuated by said control means to maintain the discharge circuit in open condition after the passage of a predetermined time from actuation of said switching means to open the discharge circuit whenever said monitoring means provides an output signal, the intensity of reflected light incident upon the film from the object to be photographed being at a predetermined level, independent of the distance to the object, the intensity of the flash being substantially constant independent of the distance of the object, the exposure time constant being maintained to maintain a predetermined photographic density, said switching means being actuated initially to close the discharge circuit by a control signal from said control means when said trigger circuit triggers said flashtube, said switching means being actuated by said control means to maintain the discharge circuit in closed state until said monitoring means provides an output signal, said switching means being actuated by said control means to repeatedly close and open said discharge circuit for a predetermined period when said monitoring means provides said output signal, said switching means being actuated by said control means to maintain said discharge circuit in open state after lapse of said predetermined period.

2. An electronic flash sytem in accordance with claim 1, wherein said monitoring means includes a photoelectric element receiving the reflected light from the object, and an amplifying circuit for amplifying the photocurrent from the photoelectric element, the amplyfying circuit generating the output signal applied to the control means.

3. An electronic flash system in accordance with claim 2, wherein said monitoring means has a diaphragm mechanism which is disposed forwardly of said photoelectric element and which varies the quantity of the reflected light from the object incident upon the photoelectric element, the diaphragm mechanism being adapted to control light quantity incident upon the photoelectric element in accordance with the degree of the camera lens aperture and sensitivity of the film to be used.

4. An electronic flash system in accordance with claim 1, wherein the monitoring means includes a variable resistor for varying the amplfication degree of the amplifying circuit in accordance with the camera lens aperture degree and sensitivity of the film to be used.

5. An electronic flash system in accordance with claim 2, wherein said control means comprises first and second transistor alternatively repeating conducting and nonconducting conditions depending upon the output of the monitoring circuit for a predetermined period, said switching means being controlled to break said discharge circuit whenever the second transistor is in nonconducting condition.

6. An electronic flash system in accordance with claim 5, wherein said control means further comprises a capacitor by which electrical energy is charged through at least one resistance when said flashtube is triggered by said trigger circuit, said first and second transistors being adapted to repeat conducting and nonconducting conditions alternatively for the period determined by the time constant of the resistance and capacitor.

7. An electronic flash system in accordance with claim 5, wherein said control means includes a monostable circuit changeable from stable condition to nonstable condition when said flashtube is triggered by the trigger circuit, said first and second transistors repeating conducting and nonconductive conditions alternatively until the monostable circuit is returned to the stable condition.

8. An electronic flash system in accordance with claim 1, wherein said switching means includes a transistor in which emitter and collector electrodes are connected in series with each other between said electric energy storage means and said flashtube, the transistor being such that the flow of its base electrode current is controlled by said control signal generated from said control means to control supply of electric energy from said electric energy to said flashtube.

9. An electronic flash system in accordance with claim 8, wherein an inductor is connected in series with said transistor and said flashtube of said switching means and wherein a capacitor is connected between the emitter and collector of said transistor.

* * * * *